United States Patent [19]

Schmidt et al.

[11] Patent Number: 4,831,778

[45] Date of Patent: May 23, 1989

[54] UPPER WINDOW SASH WITH PROJECTIONS FOR SIMPLIFIED SASH INSTALLATION AND REMOVAL

[75] Inventors: Dietrich F. Schmidt, Etters; David R. Johnson; J. Carson Jackson, both of Mechanicsburg, all of Pa.

[73] Assignee: Capitol Products Corporation, Mechanicsburg, Pa.

[21] Appl. No.: 95,612

[22] Filed: Sep. 11, 1987

[51] Int. Cl.[4] ..... E05D 15/16

[52] U.S. Cl. ..... 49/453; 49/463

[58] Field of Search ..... 49/453, 454, 463, 465, 49/63

[56] References Cited

U.S. PATENT DOCUMENTS

| | | | |
|---|---|---|---|
| 2,509,582 | 5/1950 | Webster | 49/453 |
| 2,740,998 | 4/1956 | Zitomer | 49/453 |
| 2,934,799 | 5/1960 | Nelson, Sr. | 49/453 |
| 3,122,797 | 3/1964 | Segre | 49/453 X |
| 3,129,470 | 4/1964 | Schneider | 49/63 X |
| 4,079,549 | 3/1978 | Wood | 49/453 X |
| 4,087,941 | 5/1978 | Wolfe | 49/453 X |

*Primary Examiner*—Philip C. Kannan

*Attorney, Agent, or Firm*—Edgar E. Spielman, Jr.

[57] ABSTRACT

An upper sash of a frame window or door assembly which is provided with projections extending below the lower rail of the upper sash, wherein the projections engage and cooperate with a notch found on the flange of the jamb of the frame assembly in a manner so as to support and restrict movement of the upper sash.

16 Claims, 6 Drawing Sheets

UPPER WINDOW SASH WITH PROJECTIONS FOR SIMPLIFIED SASH INSTALLATION AND REMOVAL

BACKGROUND OF THE INVENTION

1. Field of the Invention

This invention relates to frame window or door assemblies and more particularly to the lower rail of an upper sash. This invention is particularly applicable to single hung windows where the upper sash is fixed but removable and the lower sash is operable.

2. Description of the Related Art

Single hung windows with fixed upper sashes are currently constructed in a manner that the fixed upper sash is held in place by screws. These screws are installed through the upper sash into a fin or flange in the window jambs on the external side of the house, or they may be screwed into the jambs from the inside of the house, or a combination of the two. Normally, screws project through the sash into the jamb although the order could be reversed.

Current construction techniques also encompass fixed lites where the glaze (or glass) is directly attached to the frame.

A problem with using screws to secure the upper sash is that screws are time consuming to remove and require a screw driver or special tool. Reinstalling the upper sash can be troublesome because the hole for the screw within the window jamb and the screw hole in the upper sash must be aligned before the screws can properly be inserted. Fixed Lite windows present an equally significant problem in that the glaze cannot be removed at all.

Removal of the upper sash is necessary for two primary reasons. One, if the window is on an upper story of the building, the sash needs to be removed for convenient cleaning or replacing broken glass. Secondly, contractors frequently will frame up a house, close in the walls and install the windows before any inside completion takes place. The reason for this is to limit exposure to the weather and often for bank interim financing purposes where disbursement of funds are based on the stage of construction. Consequently, the exterior of a house is often substantially complete before dry wall is carried in for installation. Dry wall is often brought in through the windows. Windows where the upper sash is secured by screws or where there is a fixed meeting rail create a problem for the housing contractor because entry with dry wall or other large items is difficult. A fixed meeting rail is an extra support running between the jambs, usually at a location where the upper and lower sashes meet.

An additional problem is that security is lacking in some related art windows. Screws which are located on the outside of the window frame may be removed by a burglar, who further removes the upper sash and then unlocks the lower sash to silently gain entry without breaking the glass. Not only is there no noise to arouse the occupants, but there is also a better opportunity for the intruder to cut wires and disengage any alarms connected to the window.

SUMMARY OF THE INVENTION

This invention provides for a modification or improvement to the upper sash which provides for easy installation and removal without necessitating the use of screws or related tools. This invention pertains to a support piece which may be attached to each lower corner of the upper sash frame where the lower rail and the stile meet. The support piece is provided with a projection which will engage into a rectangular, three-sided notch at the edge of a flange in the window jamb when the upper sash is pocketed into the head of the window frame. The jambs are the two vertical components found on the side of a window frame. Pocketing is referred to as when the sash is physically pushed up into a recess in the head or top member of the window frame. Once the projection on the support piece passes through the notch and the support piece is above the flange on the window jamb, the upper sash may drop down out of the pocketed position into a position where the support piece rests on the flange. The projection is then behind the jamb flange of the frame in a position which will keep the upper sash from sliding out of place.

The applicant has solved two main problems in the related art. The first solution provides a window which has an upper sash which may be inserted and removed from the window frame without the need for tools and without the need for screws. This facilitates cleaning, reglazing and access through the window.

The second solution is that of security. There are no external screws that can be removed by a potential burglar, and the upper seal is held in place by the projection thereby stopping lateral movement. Also any further movement of the projections and hence upper sash is stopped by the proximity of the lower sash which is latched in place on the inside.

DESCRIPTION OF THE PREFERRED EMBODIMENT

Figure 1:
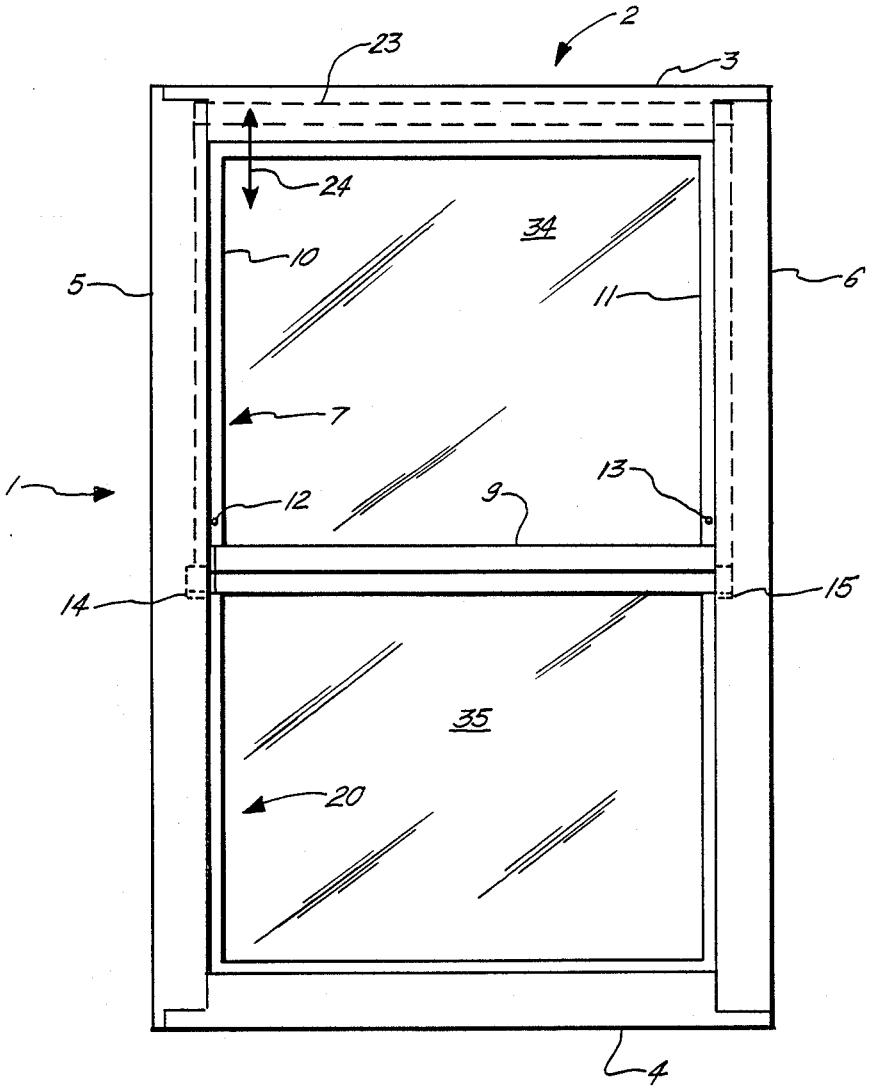
FIG. 1 is a front view of the window frame assembly showing the lower rail and support pieces. The orientation is from the interior of the building viewing outward.
Figure 2:
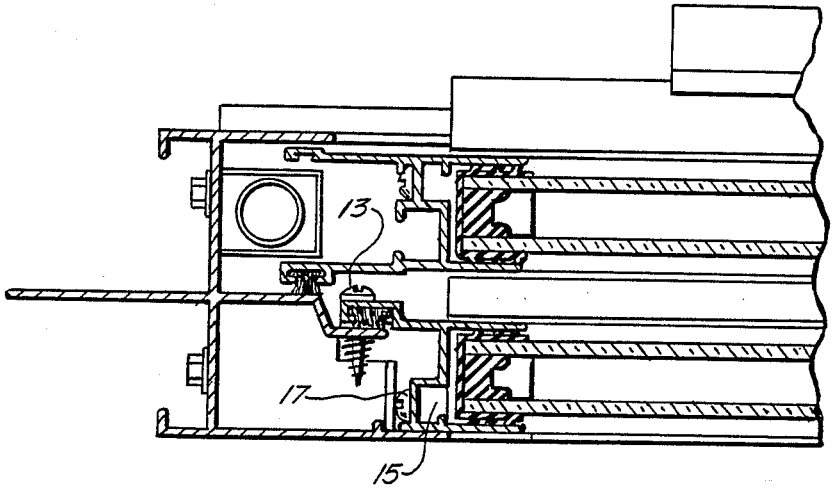
FIG. 2 is a horizontal cross-sectional view of the upper and lower sashes.

Referring now to FIG. 1, Applicant's invention in general concerns a frame window assembly 1 of all materials, or it can be modified to apply to a door assemby. The preferred embodiment concerns single hung metal windows where the upper sash is fixed but removable. However, the invention could be conceivably applied to double hung windows where the upper sash is operable. The window frame forms the outside portion of the frame window assembly and is made up of a head 3, a sill 4, and two vertical jambs 5, 6. Positioned inside frame 2 is an upper sash 7 having an upper rail 8, a lower rail 9 and two vertical stiles 10, 11 which contain one or two glass panels 34. The preferred embodiment is provided with frame screws 12 and 13. These screws are used for shipping purposes to help hold the frame rigid and also may be used to further support the frame assembly when installed within the building wall at times when upper and lower sashes (7 and 20, respectively) are in place. However, frame screws 12 and 13 are not necessary to make this invention operable, and the screws could be substituted with appropriate banding for shipping purposes.

Figure 3:
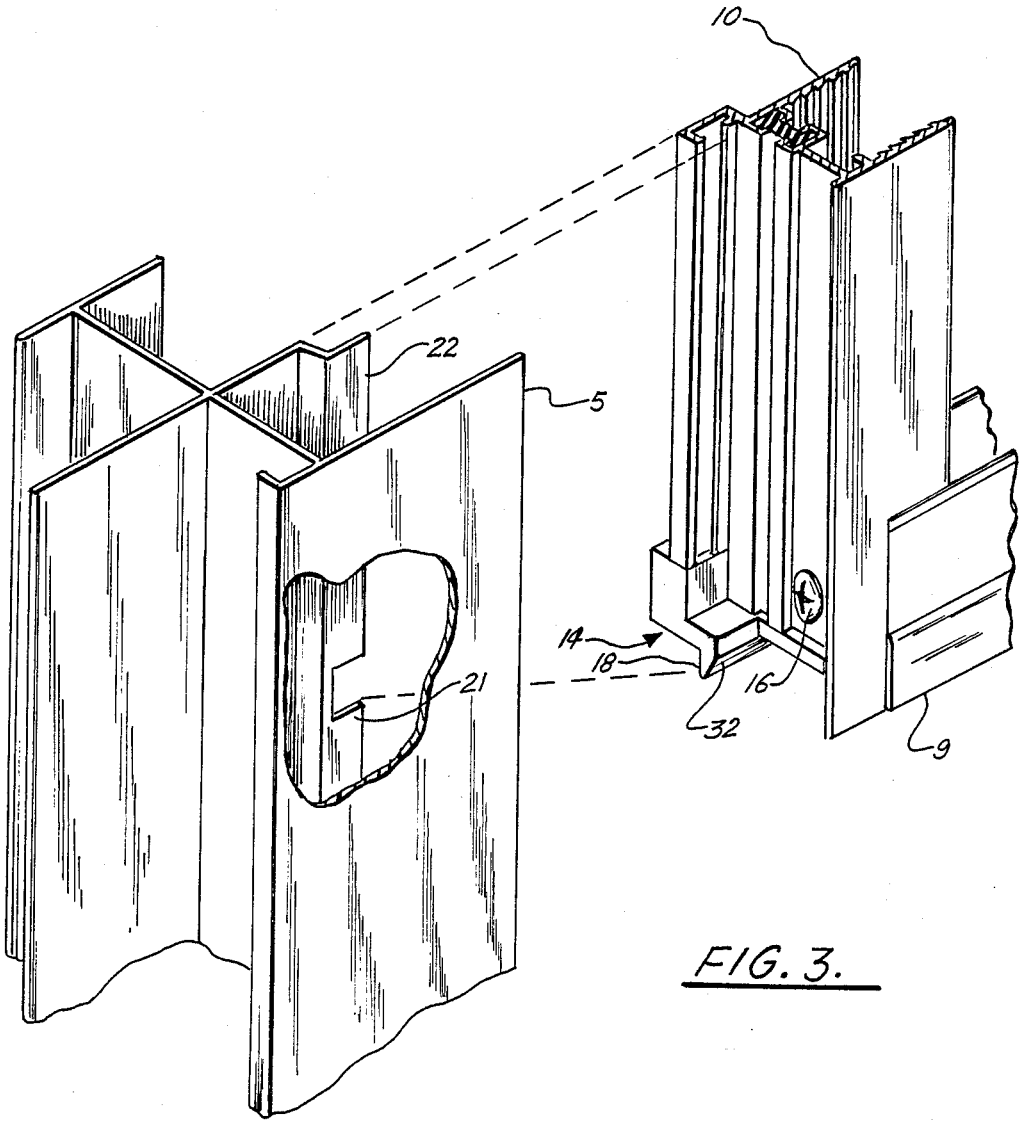
FIG. 3 is a perspective view of the lower rail of an upper sash showing at its lower corner the support piece having an integral projection and further showing in dashed outline form the notch of the flange on the window frame jamb. The opposite side of the lower rail is shown from that side viewed in FIG. 2.
Figure 4:
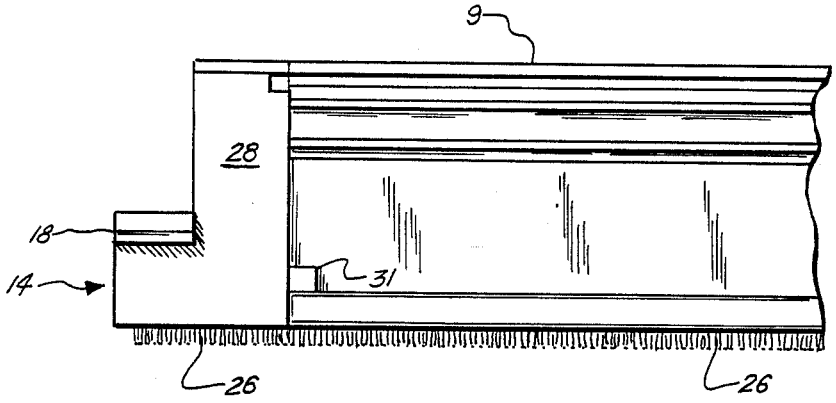
FIG. 4 is a bottom view showing the same support and integral projection from a view below FIG. 3 and showing the underside of the support piece.

The lower rail 9 as well as the lower portion of stile 10 is shown in detail in FIG. 3. Applicant's invention is integrally mounted to lower rail 9 of upper sash and concerns the support pieces 14, 15. These support pieces are of identical but reversed mirror image design. These support pieces 14, 15 are attached to the lower rail 9 by support piece screws 16, 17, respectively, which are positioned through an aperture as shown at 30 within each of support pieces 14 and 15 and run through stiles 10 and 11 before attaching to the lower rail. Projections 18 and 19 are integrally formed with and extend downward from the support pieces 14 and 15 respectively. These projections are used to hold the upper sash in position and are dimensioned to slip through a notch as shown at 21 found on a flange 22 of jamb 5. A projection such as 18 is allowed to slip through notch 21 when the upper sash 7 is pocketed within the head 3. When the upper sash 7 is pocketed, the upper rail 8 is raised within the head 3 to a level depicted by dotted line 23 on FIG. 1. When the upper sash is allowed to fall back down into normal position, projection 18 takes its position behind notch 21 of flange 22 of jamb 5 as shown on FIG. 3. This allowable up-and-down motion is depicted by arrow 24. Jamb 6 will have corresponding projection 15 fitting into a notch (not shown) in jamb 6.

Figure 10:
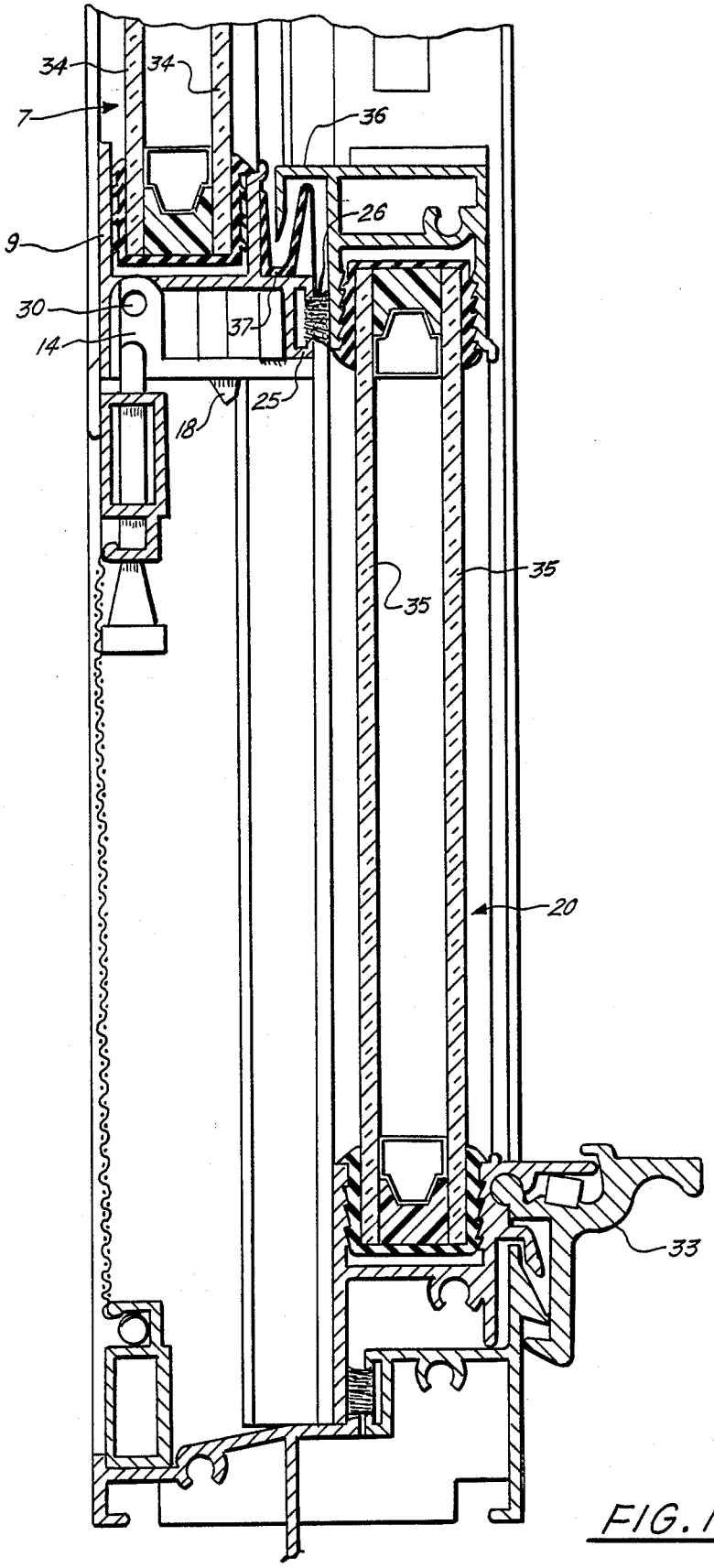
FIG. 10 is a vertical, cross-sectional view showing the juncture of the lower rail of the upper sash and the upper rail of the lower sash as well as the entire lower sash.

When the lower sash 20 enclosing glass panels 35 is in place and locked by latch 33 as shown in FIG. 10, the upper sash 7 is secured from movement because there is no place for projections 18, 19 to horizontally move. Further, vertical movement is prevented by the perimeter of a notch as shown at 21 as well as interlock 36 or sash 20 which fits over corresponding interlock 37 on the upper sash 7.

Figure 5:
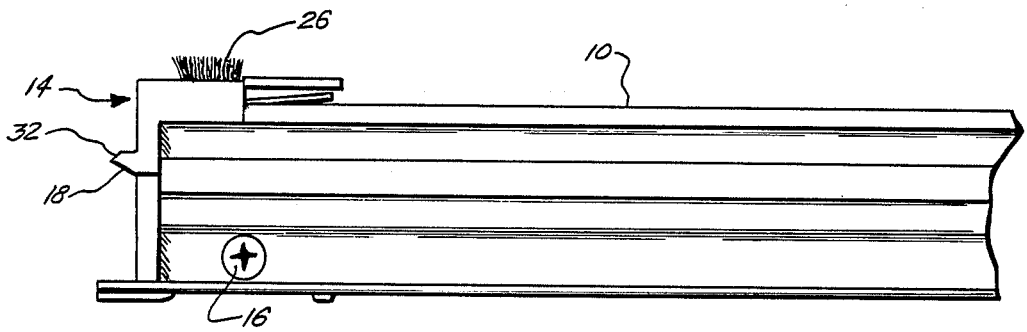
FIG. 5 is a side view showing the support piece and rail of FIG. 3.
Figure 6:
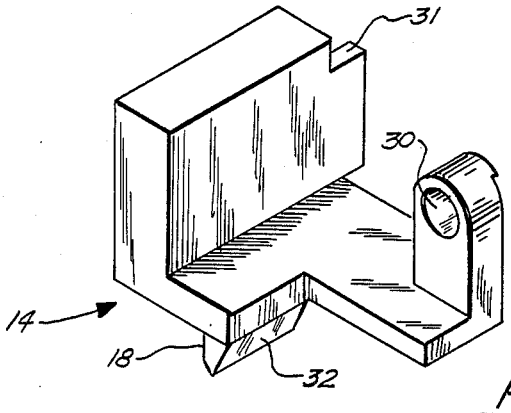
FIG. 6 is a perspective view of the support piece.
Figure 7:
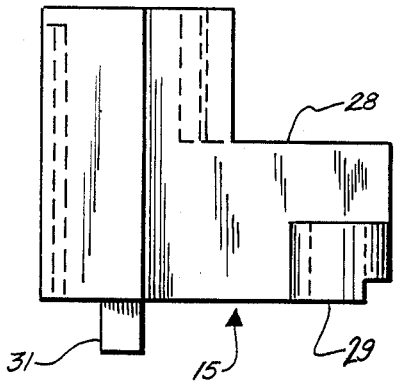
FIG. 7 is a top view of the support piece.
Figure 8:
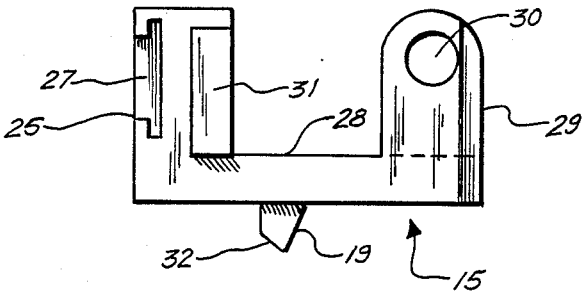
FIG. 8 is a front view of the support piece.
Figure 9:
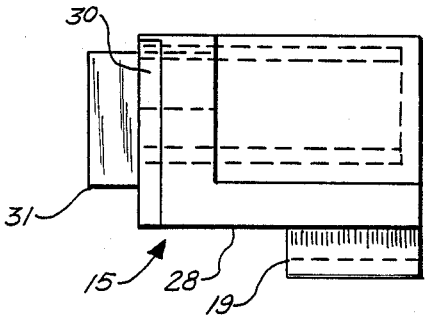
FIG. 9 is a side view of the support piece.

As shown in FIG. 8, the support pieces 14 and 15 are further provided with a channel as shown by 25 on each support piece for holding a length of weather stripping 26 (FIG. 5). The weather stripping is held in place on the support piece by an end stop 27 (FIG. 8). Support piece 15 is further provided with a base member 28 which has an integral upward extension 29 having an aperture 30 for attaching the support piece 15 to the lower rail 9 with a support piece screw 17. The preferred embodiment of the base member 28 has an L-shape when viewed from the top (FIG. 7). This shape allows the projection 19 to fit in the notch (not shown) without having the base support extend outward from the lower rail 9 any more than is necessary. The base support 28 is also provided with a tab 31 for fitting behind the flange which holds the weather stripping on the lower rail 9 allowing for further alignment when installing the support piece 15 on the lower rail 9. Support piece 14 has identical features but is reversed to fit the opposite side of the lower rail 9 so that projection 18 is on the outside of the support piece 14 and is attached by support piece screw 16. Projections 18 and 19 are further provided with a camber 32 to assist in positioning the upper sash on the notches on the kind shown at notch 21.

Many other variations, modifications, and alternate embodiments may be made in the apparatus and techniques hereinbefore described, by those having experience in this technology, without departing from the concept of the present invention. Accordingly, it should be clearly understood that the apparatus and methods depicted in the accompanying drawings and referred to in the foregoing description are illustrative only and are not intended as limitations on the scope of this invention, as defined in the following claims.

What is claimed is:

1. In a frame window or door assembly of the type in which an upper sash, having two stiles, a lower rail and an upper rail, is bounded by frame jambs adjacent to and cooperating with said stiles of said sash and by a frame head adjacent to and cooperating with said upper rail of said sash, the improvement which comprises;

(a) one or more projections, affixed to and extending below the lower rail and extending horizontally beyond the juncture of the stile and lower rail of the upper sash; and (b) a jamb having a notched means for receiving and restricting each said projection from movement.

2. In a frame window or door assembly of claim 1 wherein each said projection is provided with a cambered side toward the inside of the window cooperating with said notched means in a manner to assist in positioning said upper sash in a fixed position.

3. In a frame window or door assembly of claim 1 wherein said upper sash is fixed in a manner of a single-hung window.

4. In a frame window or door assembly of claim 1, wherein said projections number two.

5. In a frame window or door assembly of claim 1, wherein each said projection further comprises a base support integral to said projection for affixing said projection to said upper sash.

6. In a frame window or door assembly of claim 5 wherein each said base support is provided with a channel for receiving weather stripping.

7. In a frame window or door assembly of claim 6 wherein said channel for holding weather stripping is further provided with a end stop to prevent the weather stripping from extending past the end of said channel.

8. In a frame window or door assembly of claim 1 wherein said jamb having a notched means further comprises a rectangular slot for receiving and restricting said projection from movement.

9. In a frame window or door assembly of claim 8 wherein said rectangular shaped slot further comprises a threesided notch having an opening at a fourth side.

10. A method of removing an upper sash of a frame window or door assembly having a window frame head, upper rail, lower rail, protrusion, notch and window jamb comprising the steps of (1) pocketing the upper sash by moving the upper rail into the recess of the window frame head; (2) moving the lower rail of the upper sash so that the protrusion passes through and away from the notch on the window jamb; and (3) removing the upper sash from the window frame assembly.

11. One or more support pieces adapted to fit a lower rail of an upper sash of a frame window or door assembly for holding said upper sash in place and acting in cooperation with a jamb having a receiving notch which comprises:

(a) a base member connected near the end of said lower rail for supporting said lower rail; and (b) a projection affixed to and extending downwardly and horizontally below said base member adapted to engage said notch; and (c) a means for attaching said base member to said lower rail.

12. A support piece adapted to fit a lower rail of an upper sash of a frame window or door assembly of claim 11, wherein said projection is further provided with a camber for positioning said support piece on said jamb.

13. A support piece adapted to fit a lower rail of an upper sash of a frame window or door assembly of claim 11, wherein said base member further comprises an L-shape for allowing clearance between the lower rail and the frame.

14. A support piece adapted to fit a lower rail of an upper sash of a frame window or door assembly of claim 11, wherein said means for attaching said base member to said lower rail further comprises an extension affixed to and extending above said base member having an aperture for receiving a screw or bolt.

15. A support piece adapted to fit a lower rail of an upper sash of a frame window or door assembly of claim 11, wherein said base member further comprises a channel affixed to and extending above said base member for receiving weather stripping.

16. A support piece adapted to fit a lower rail of an upper sash of a frame window or door assembly of claim 11, said support piece having a channel for receiving weather stripping, said channel having an end stop to prevent said weather stripping from extending past the end of the channel.

* * * * *